US008307834B1

(12) United States Patent
Palmerino, Sr. et al.

(10) Patent No.: US 8,307,834 B1
(45) Date of Patent: Nov. 13, 2012

(54) CIGARETTE CASE SMOKING CESSATION DEVICE

(76) Inventors: Jerome T. Palmerino, Sr., Baltimore, MD (US); Michael J. Minutelli, Baltimore, MD (US)

( * ) Notice: Subject to any disclaimer, the term of this patent is extended or adjusted under 35 U.S.C. 154(b) by 2 days.

(21) Appl. No.: 13/171,339

(22) Filed: Jun. 28, 2011

(51) Int. Cl.
*A24F 15/00* (2006.01)

(52) U.S. Cl. ..... 131/270; 368/10; 206/242; 206/265

(58) Field of Classification Search ..... 206/242, 206/247, 264, 265, 268, 1.5, 236; 131/270, 131/329; 368/10, 276; 116/2, 67 R; 70/273; 221/15

See application file for complete search history.

(56) References Cited

U.S. PATENT DOCUMENTS

| | | | | | |
|---|---|---|---|---|---|
| 2,016,534 | A | * | 10/1935 | Blackwell et al. | 70/273 |
| 2,613,527 | A | * | 10/1952 | Harris | 70/273 |
| 2,681,560 | A | * | 6/1954 | Shuttleworth et al. | 70/273 |
| 3,206,957 | A | * | 9/1965 | Reitzes | 70/272 |
| 3,424,123 | A | * | 1/1969 | Giffard | 116/2 |
| 3,655,325 | A | * | 4/1972 | Toppel | 369/67 |
| 3,722,742 | A | * | 3/1973 | Wertz | 221/15 |
| 3,999,412 | A | | 12/1976 | Boroski et al. | |
| 4,037,719 | A | * | 7/1977 | Perlmutter | 206/266 |
| 4,076,118 | A | * | 2/1978 | Karlsson | 206/268 |
| 4,084,415 | A | * | 4/1978 | Corman | 70/269 |
| 4,615,681 | A | * | 10/1986 | Schwarz | 434/236 |
| 4,620,555 | A | | 11/1986 | Schwarz | |
| 4,862,431 | A | | 8/1989 | Drouin | |
| 5,203,472 | A | * | 4/1993 | Levenbaum et al. | 221/15 |
| 5,405,045 | A | * | 4/1995 | Usmani | 221/7 |
| 5,566,855 | A | * | 10/1996 | Bradach | 221/15 |
| 6,125,082 | A | * | 9/2000 | Reid | 368/10 |
| D440,352 | S | * | 4/2001 | Gore et al. | D27/191 |
| 6,606,997 | B2 | * | 8/2003 | Brue | 131/270 |
| 6,693,850 | B2 | | 2/2004 | Mulaw | |
| 6,712,075 | B1 | * | 3/2004 | Garcia | 131/270 |
| 2002/0145002 | A1 | * | 10/2002 | Hung | 221/15 |
| 2004/0050397 | A1 | * | 3/2004 | Garcia | 131/270 |

* cited by examiner

*Primary Examiner* — Steven A. Reynolds

(57) ABSTRACT

The cigarette case smoking cessation device only allows lid opening and therefore cigarette access at times set by the adjustable timer. The device thereby allows a smoker to predetermine cigarette access in designing a period for weaning off of cigarettes, of just reducing smoking itself. The device provides automatic unlocking at the set intervals, thereby allowing lid opening. The device provides both audio and vibratory alert of cigarette access. The device provides a gasket between case and lid so that cigarettes stay fresh. The charge port is an important feature in assuring battery charge and therefore long-life operation between charges. The thin walled device is compact and only slightly larger than a cigarette pack itself.

2 Claims, 6 Drawing Sheets

CIGARETTE CASE SMOKING CESSATION DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Smokers are proof of the difficulties involved in smoking cessation. Nicotine patches, gadgets, tricks, and any number of ideas and devices have been employed in efforts to help smokers either quit smoking cold turkey or gradually stop smoking. The present device provides a cigarette case that holds a pack of cigarettes and provides a timer-open function in helping a smoker gradually scale back on and then stop cigarette smoking.

FIELD OF THE INVENTION

The cigarette case smoking cessation device relates to cigarette cases and more especially to a cigarette case that aids a smoker in smoking cessation.

SUMMARY OF THE INVENTION

The general purpose of the cigarette case smoking cessation device, described subsequently in greater detail, is to provide a cigarette case smoking cessation device which has many novel features that result in an improved cigarette case smoking cessation device which is not anticipated, rendered obvious, suggested, or even implied by prior art, either alone or in combination thereof.

To attain this, the cigarette case smoking cessation device only allows lid opening and therefore cigarette access at times set by the adjustable timer. The device thereby allows a smoker to predetermine cigarette access in designing a period for weaning off of cigarettes, of just reducing smoking itself. The device may provide automatic unlocking at the set intervals, thereby allowing lid opening. The lid may be spring loaded to assist opening. The device may provide both audio and vibratory alert of cigarette access. It is important to note that not all users want an audio alert, as such can be embarrassing and also interruptive in various situations. The vibratory alert is therefore a critical feature. Both alerts may also be used in unison. The device may also provide a gasket between case and lid so that cigarettes stay fresh. The charge port is an important feature in assuring battery charge and therefore long-life operation between charges. The thin walled device is compact and only slightly larger than a cigarette pack itself. The slants of the case and the lid importantly provide best cigarette access and match most cigarette packs. The positive, tamperproof lid locking mechanism is an important feature.

Thus has been broadly outlined the more important features of the improved cigarette case smoking cessation device so that the detailed description thereof that follows may be better understood and in order that the present contribution to the art may be better appreciated.

An object of the cigarette case smoking cessation device is to house a pack of cigarettes.

Another object of the cigarette case smoking cessation device is to provide for a user to set a adjustable timer that allows cigarette access at set times only.

A further object of the cigarette case smoking cessation device is to alert a user when a cigarette is available.

Still another object of the cigarette case smoking cessation device is to alert a user when a cigarette is available, by sound.

Another object of the cigarette case smoking cessation device is to alert a user when a cigarette is available, by vibration.

An object of the cigarette case smoking cessation device is to hold a commonly size cigarette pack.

An added object of the cigarette case smoking cessation device is to keep cigarettes fresh.

And, an object of the cigarette case smoking cessation device is to be compact.

Another object of the cigarette case smoking cessation device is to provide best cigarette access.

These together with additional objects, features and advantages of the improved cigarette case smoking cessation device will be readily apparent to those of ordinary skill in the art upon reading the following detailed description of presently preferred, but nonetheless illustrative, embodiments of the improved cigarette case smoking cessation device when taken in conjunction with the accompanying drawings.

DETAILED DESCRIPTION OF THE DRAWINGS

With reference now to the drawings, and in particular FIGS. 1 through 6 thereof, the principles and concepts of the cigarette case smoking cessation device generally designated by the reference number 10 will be described.

Figure 3:
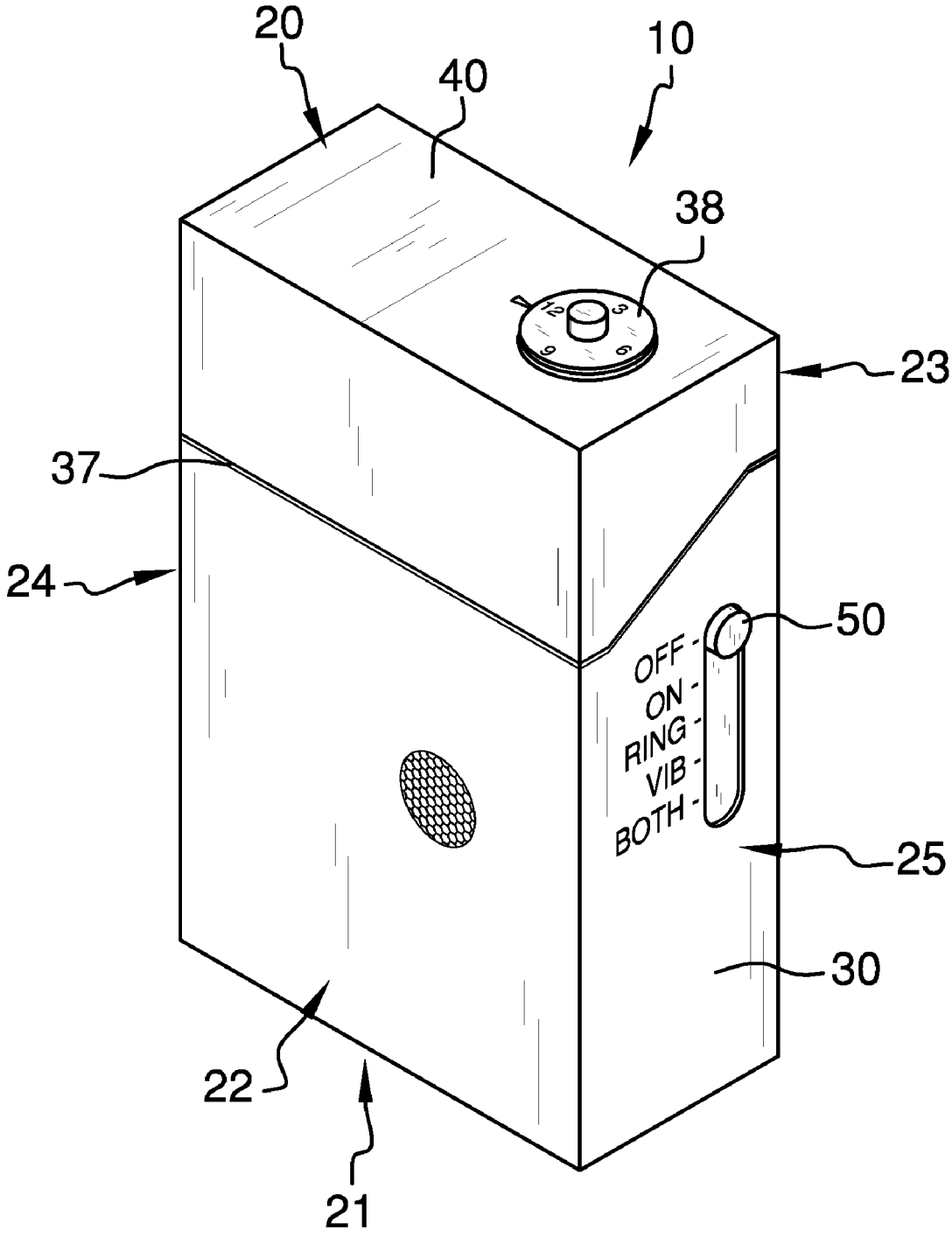
FIG. 3 is a top perspective view.

Referring to FIG. 3, the device 10 partially comprises a top 20 spaced apart from a bottom 21, a front 22 spaced apart from a back 23, and a first side 24 spaced apart from a second side 25.

Figure 2:
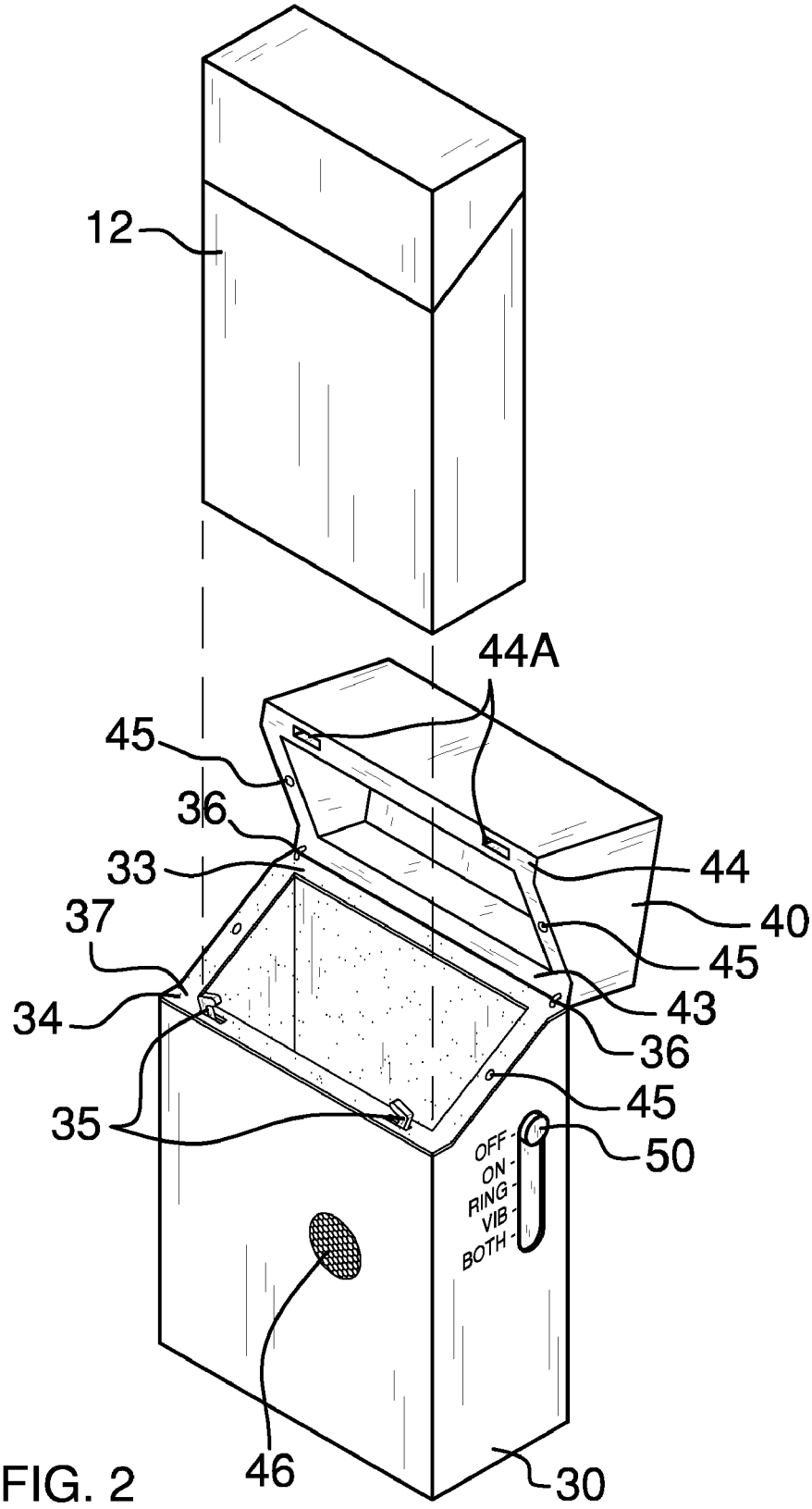
FIG. 2 is a top perspective view, in preparation of cigarette pack insertion.

Referring to FIG. 2, the hollow case 30 has a case slant 32 at the case 30 top 20. An upper horizontal 33 is disposed atop the case 30 above the case slant 32. The lower horizontal 34 is disposed atop the case 30 below the case slant 32. The pair of spaced apart pivotal lock hooks 35 is extended upwardly from the lower horizontal 34. The gasket 37 is disposed peripherally atop the case 30 top 20.

Referring to FIG. 3, the adjustable timer 38 is disposed within the case 30 top 20.

Referring again to FIG. 2, the hollow lid 40 is hingedly disposed atop the hollow case 30. The lid slant 42 removably mates to the case slant 32. The lid upper horizontal 43 movably mates to the case 30 upper horizontal 33. The lid lower horizontal 44 movably mates to the case 30 lower horizontal 34. The pair of spaced apart lock slots 44A is disposed in the lid lower horizontal 44. One of each of one of the lock slots 44A is mated to a one of each of the pivotal lock hooks 35. The pair of spaced apart contacts 45 is disposed within the case slant 32. The pair of spaced apart contacts 45 is disposed within the lid slant 42. The lid 40 contacts 45 moveably mate to the case 30 contacts 45.

Figure 1:
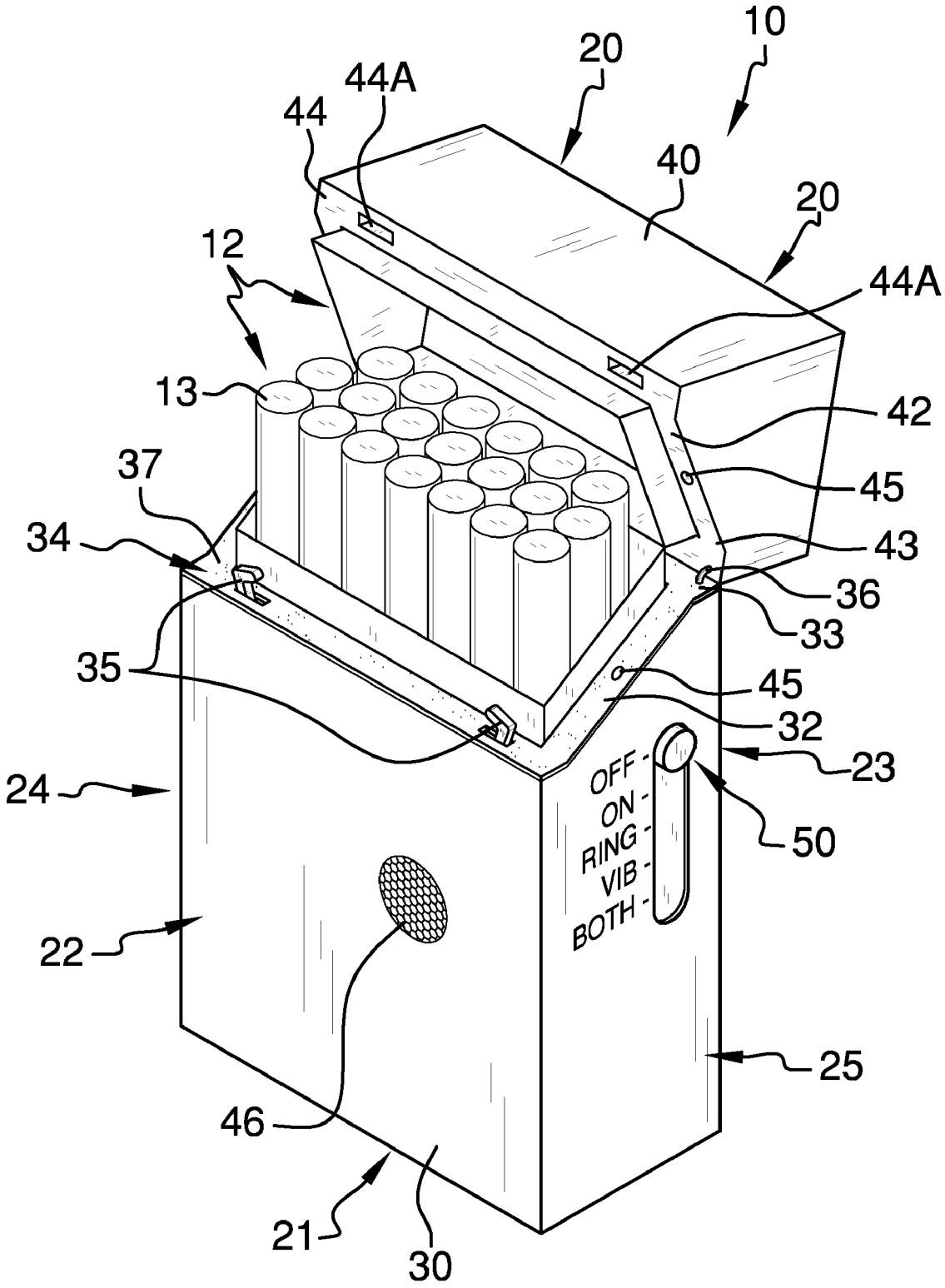
FIG. 1 is a perspective in-use view.
Figure 6:
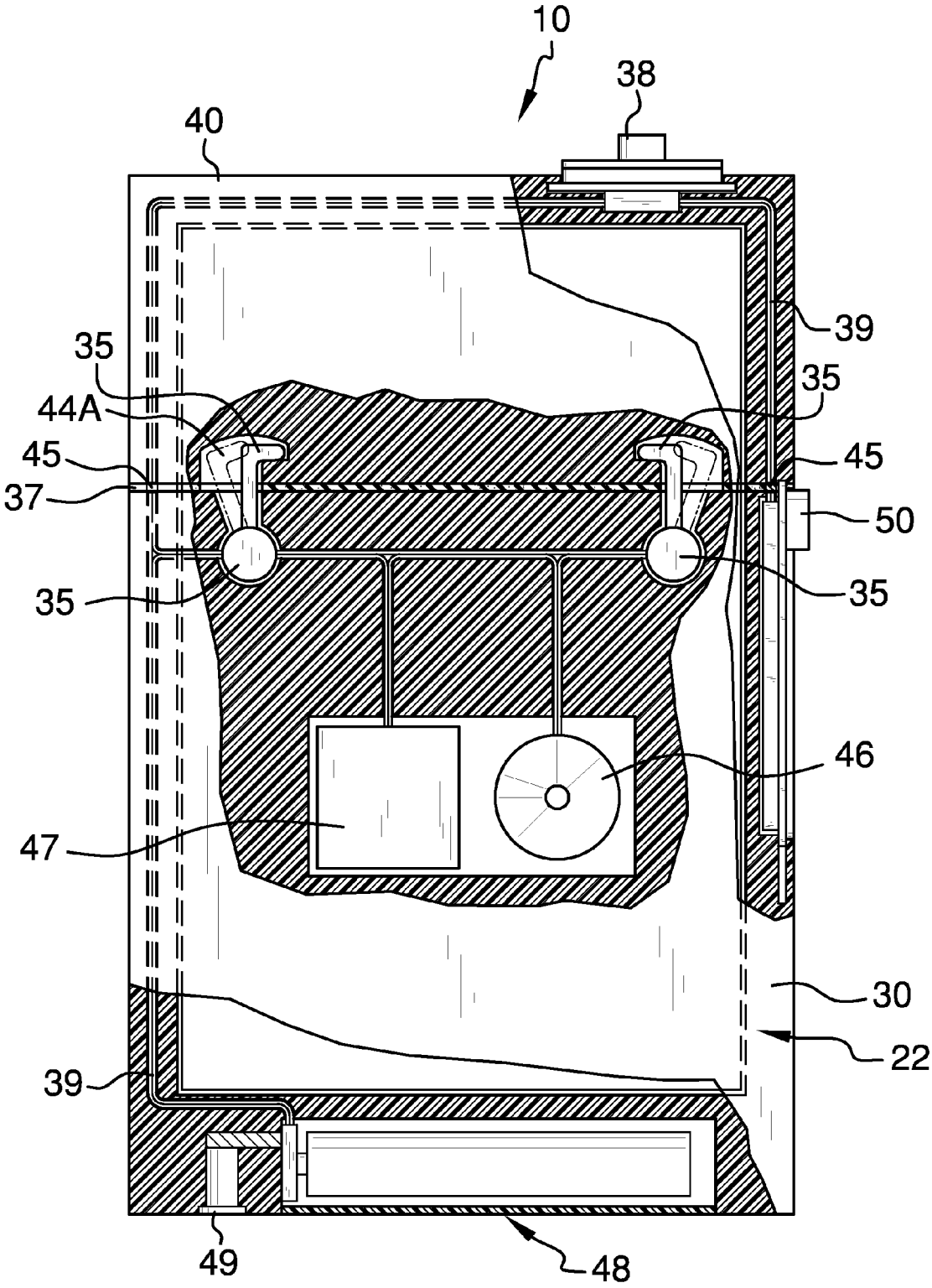
FIG. 6 is a frontal partial cross sectional view.

Referring to FIG. 6 and FIG. 1, the speaker 46 is disposed within the case 30 front 22. The vibrator 47 is disposed within the case 30.

Figure 4:
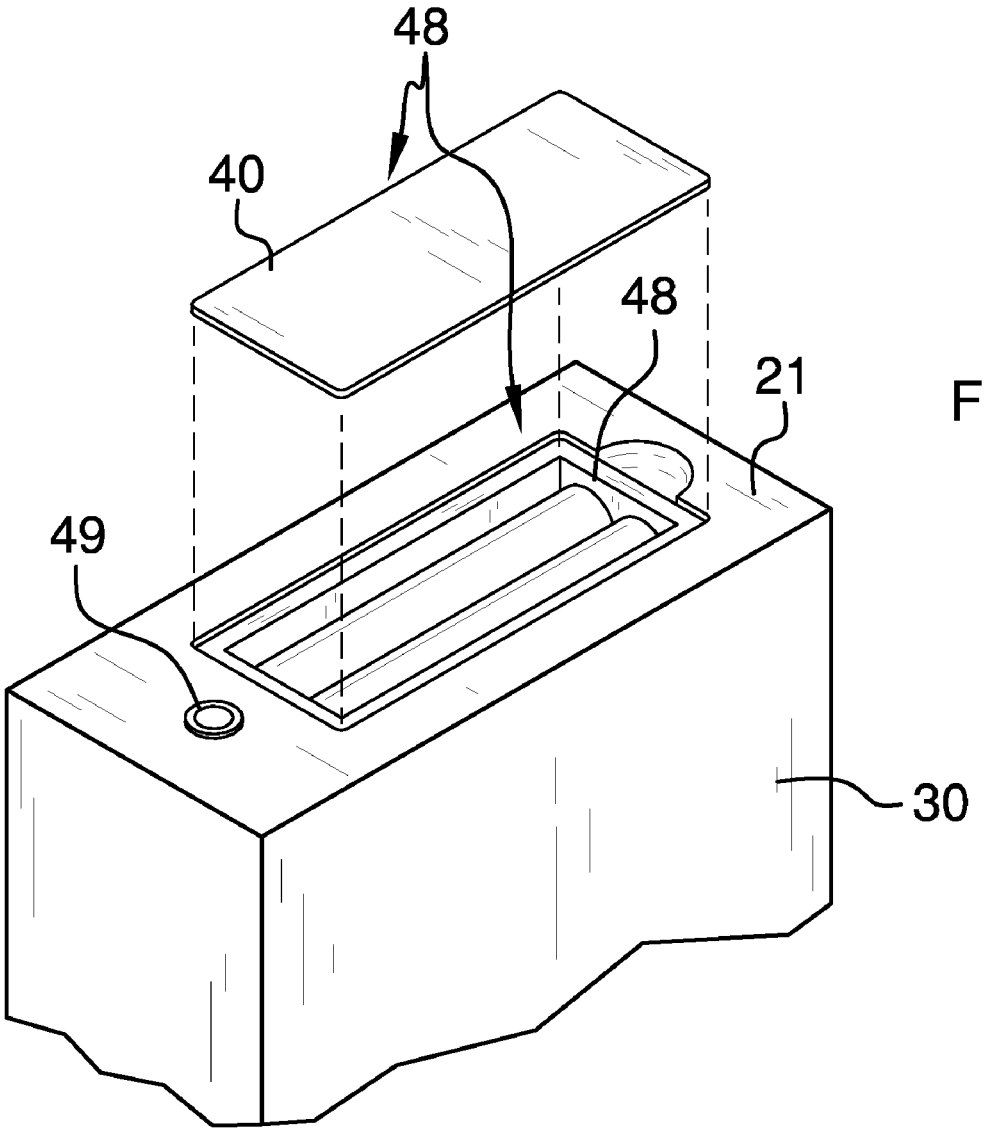
FIG. 4 is a bottom perspective view featuring the battery pack.

Referring to FIG. 4, the battery pack 48 is disposed within the case 30 bottom 21. The charge port 49 is disposed within the case 30 adjacent to the battery pack 48. The controls 50 is disposed within the case 30. The controls 50 provide for on/off, speaker 46, and vibrator 47 control wherein only the speaker 46 may be used, only the vibrator 47 may be used, and both the speaker 46 and vibrator 47 may be employed simultaneously. The controls 50, the battery pack 48, the vibrator 47, the speaker 46, the contacts 45, the timer 38, and the pivotal lock hooks 35 are connected via electrical connections 39.

Figure 5:
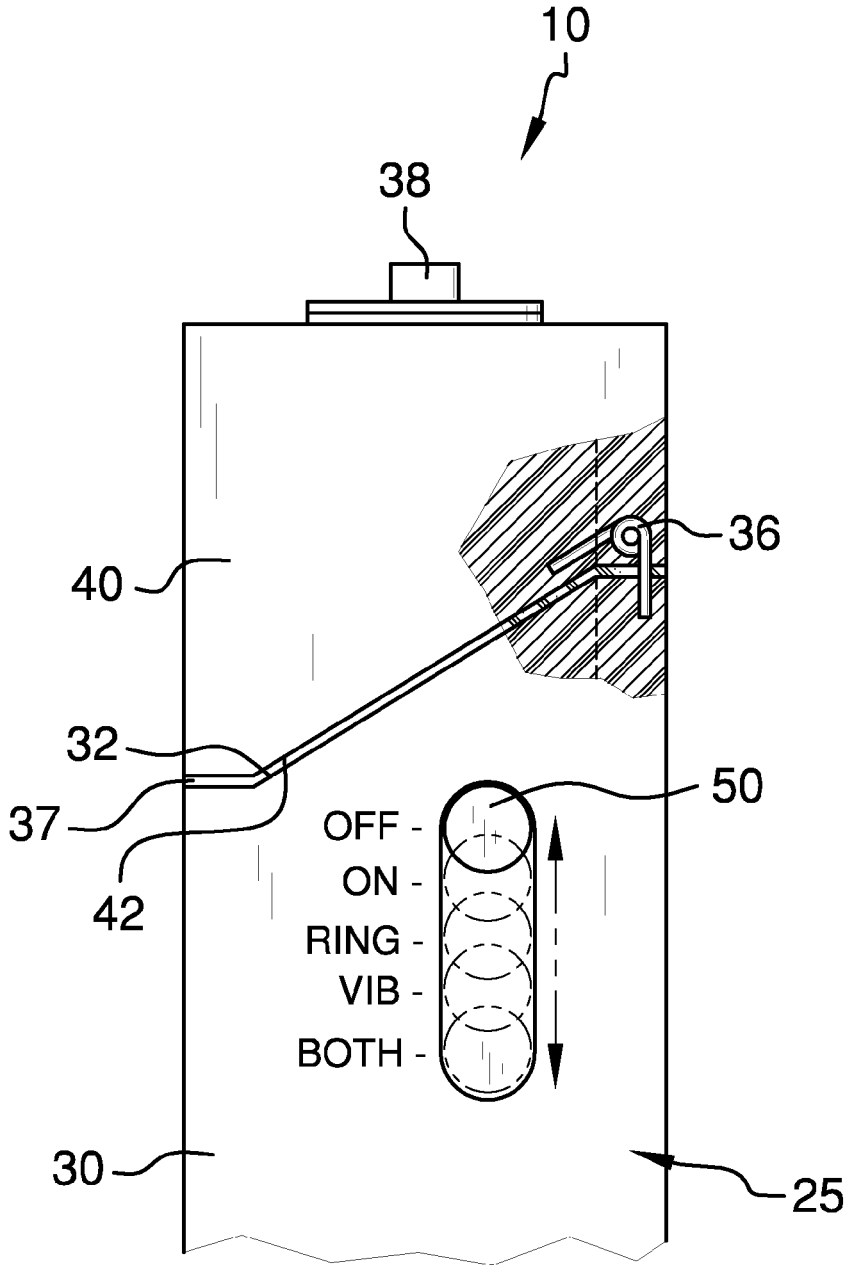
FIG. 5 is a second side partial cross sectional elevation view.

Referring to FIG. 5, the expansion springs 36 assist opening of the hollow lid 40.

Referring to FIG. 1, cigarettes 13 may be removed individually with the hollow lid 40 opened.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the cigarette case smoking cessation device may be used.

What is claimed is:

1. A cigarette case smoking cessation device comprising, in combination:

a top spaced apart from a bottom, a front spaced apart from a back, and a first side spaced apart from a second side;
a hollow case;
a case slant at the hollow case top;
an upper horizontal disposed atop the case above the case slant;
a lower horizontal disposed atop the case below the case slant;
a pair of spaced apart pivotal lock hooks extended upwardly from the lower horizontal;
a gasket disposed peripherally atop the hollow case top;
a adjustable timer disposed within the hollow case top;
a hollow lid hingedly disposed atop the hollow case;
a lid slant removably mated to the case slant;
a lid upper horizontal movably mated to the hollow case upper horizontal;
a lid lower horizontal movably mated to the hollow case lower horizontal;
a pair of spaced apart lock slots disposed in the lid lower horizontal, a one of each of one of the lock slots mated to a one of each of the pivotal lock hooks;
a pair of spaced apart contacts disposed within the case slant;
a pair of spaced apart contacts disposed within the lid slant, the lid contacts moveably mated to the case contacts;
a speaker disposed within the hollow case front;
a vibrator disposed within the hollow case;
a battery pack disposed within the hollow case bottom;
a charge port disposed within the case adjacent to the battery pack;
a controls disposed within the hollow case, the controls, the battery pack, the vibrator, the speaker, the contacts, the timer, and the pivotal lock hooks connected via electrical connection.

2. A cigarette case smoking cessation device comprising, in combination:

a top spaced apart from a bottom, a front spaced apart from a back, and a first side spaced apart from a second side;
a hollow case;
a case slant at the hollow case top;
an upper horizontal disposed atop the case above the case slant;
a lower horizontal disposed atop the case below the case slant;
a pair of spaced apart pivotal lock hooks extended upwardly from the lower horizontal;
a gasket disposed peripherally atop the hollow case top;
a adjustable timer disposed within the hollow case top;
a hollow lid hingedly disposed atop the hollow case;
a pair of spaced apart expansion springs connected to the hollow case and the hollow lid;
a lid slant removably mated to the case slant;
a lid upper horizontal movably mated to the hollow case upper horizontal;
a lid lower horizontal movably mated to the hollow case lower horizontal;
a pair of spaced apart lock slots disposed in the lid lower horizontal, a one of each of one of the lock slots mated to a one of each of the pivotal lock hooks;
a pair of spaced apart contacts disposed within the case slant;
a pair of spaced apart contacts disposed within the lid slant, the lid contacts moveably mated to the case contacts;
a speaker disposed within the hollow case front;
a vibrator disposed within the hollow case;
a battery pack disposed within the hollow case bottom;
a charge port disposed within the case adjacent to the battery pack;
a controls disposed within the hollow case, the controls, the battery pack, the vibrator, the speaker, the contacts, the timer, and the pivotal lock hooks connected via electrical connection.

* * * * *